US007337861B2

(12) United States Patent
Mong et al.

(10) Patent No.: US 7,337,861 B2
(45) Date of Patent: Mar. 4, 2008

(54) METHOD AND A DEVICE FOR PREVENTING PIPESKIDDING

(75) Inventors: Tor Egil Mong, Vigrestad (NO); Tommy Johnsen, Hafrsfjord (NO)

(73) Assignees: Malm Orstad AS, Voll (NO); Odfjell Well Services AS, Tananger (NO)

( * ) Notice: Subject to any disclaimer, the term of this patent is extended or adjusted under 35 U.S.C. 154(b) by 0 days.

(21) Appl. No.: 10/498,276

(22) PCT Filed: Nov. 29, 2002

(86) PCT No.: PCT/NO02/00454

§ 371 (c)(1),
(2), (4) Date: Jun. 3, 2004

(87) PCT Pub. No.: WO03/054343

PCT Pub. Date: Jul. 3, 2003

(65) Prior Publication Data

US 2005/0072882 A1 Apr. 7, 2005

(30) Foreign Application Priority Data

Dec. 3, 2001 (NO) ..... 20015913

(51) Int. Cl.
*E21B 19/10* (2006.01)

(52) U.S. Cl. ..... 175/423; 248/65

(58) Field of Classification Search ..... 175/85, 175/423; 173/164; 248/65, 67.7, 70, 74.1, 248/73, 74.4, 514, 519, 520
See application file for complete search history.

(56) References Cited

U.S. PATENT DOCUMENTS

| | | | | |
|---|---|---|---|---|
| 1,356,458 | A * | 10/1920 | Moody | 188/67 |
| 2,229,607 | A | 1/1941 | Poist et al. | |
| 2,736,941 | A | 3/1956 | Mullinix | |
| 2,829,617 | A | 4/1958 | Kelley | |
| 3,037,258 | A | 6/1962 | Stokes | |
| 3,579,753 | A * | 5/1971 | Pryor | 188/67 |
| 3,961,399 | A | 6/1976 | Boyadjieff | |
| 4,567,952 | A | 2/1986 | Lemaire et al. | |
| 4,715,456 | A * | 12/1987 | Poe et al. | 175/423 |
| 4,887,673 | A * | 12/1989 | Skoruppa | 166/382 |
| 5,062,756 | A * | 11/1991 | McArthur et al. | 414/22.51 |
| 5,848,647 | A * | 12/1998 | Webre et al. | 166/379 |
| 6,089,338 | A * | 7/2000 | Bouligny, Jr. | 175/423 |
| 6,450,385 | B1 * | 9/2002 | Guerin | 226/89 |

FOREIGN PATENT DOCUMENTS

GB 615015 A 12/1948

* cited by examiner

*Primary Examiner*—Amy J. Sterling
(74) *Attorney, Agent, or Firm*—Patricia M. Mathers

(57) ABSTRACT

A method and device for preventing a pipe string (5) clampingly arranged in a slips (2) from slipping out of the slips (2) in the event of the pipe string (5) slipping in the slips (2), wherein a pipe clamp/tong (22) is clamped, preferably hydraulically, onto the pipe string (5) at a position above the slips (2) and maintained in the clamped state for essentially as long as the pipe string (5) is held by the slips (2), the pipe clamp/tong (22), in the event of the pipe string (5) slipping in the slips (2), being displaced together with the pipe string (5) until the pipe clamp/tong (22) stops against the wedges (16) of the slips (2).

18 Claims, 9 Drawing Sheets

METHOD AND A DEVICE FOR PREVENTING PIPESKIDDING

This invention regards a method of securing pipes and other long objects against slipping in a fixing device, especially for securing drill pipes or other similar pipes against slipping in slips of the type used in drilling and production of petroleum. The invention also regards a device for implementing the method.

When retrieving pipe strings during drilling or other similar operations related to petroleum production, the pipe is moved through slips designed to keep the pipe string in a vertical position when screwing stands (sections of piping) on/off the pipe string.

After the pipe string has been raised/lowered by a length corresponding to a length of piping, e.g. by means of the hoisting winch of the drilling device, pipes that are not provided with an external shoulder portion must according to prior art be fitted with a clamp at a position above the slips. The slips is locked, thus gripping the drill string and keeping this in position while the lifting device is disconnected from the pipe string during connection/disconnection of a length of piping.

If the pipe string were to slip in said slips, the clamp is displaced down to a stop against the wedges of the slips. The net weight of the pipe string is transferred via the clamp to the wedges of the slips, thereby causing them to grip the pipe string more tightly. Thus use of a pipe clamp of said type prevents the pipe string from being lost down the borehole.

A new pipe clamp must be fitted prior to removing each stand from the pipe string. The work involved in fitting the pipe clamps causes considerable delay to the pull-up operation.

The pipe clamps must be removed before moving the pipe string back into the well.

The object of the invention is to remedy the disadvantages of prior art.

The object is achieved in accordance with the invention by the characteristics stated in the description below and in the appended claims.

By connecting a mechanised wedge manipulator comprising a preferably hydraulically actuated pipe clamp to the wedges of the slips, the need for manual fitting of pipe clamps to the pipe string may be eliminated without increasing the risk of losing the pipe string down the borehole.

During the raising of the drill string, the wedges of the slips are lifted out of the engaged position by means of the manipulator, allowing the pipe string to be moved through the slips sleeve in the normal manner.

When a new stand is to be disconnected from the pipe string, the wedges are lowered into the slips sleeve to the locking position. The pipe clamp of the wedge manipulator is moved up to the pipe, gripping it.

The hoisting winch of the drilling device is relieved, whereupon the slips grips and holds the pipe string in a manner that is known per se. If the pipe string were to slip in the slips, the pipe clamp is displaced downwards along with the pipe string until the pipe clamp stops against the wedges. Thus the weight of the pipe string is transferred by means of the pipe clamp to the wedges of the slips, which are then moved into a firmer grip about the pipe string.

The pipe string is released from the slips in the normal manner by the hoisting winch of the drilling device lifting the pipe string. The pipe clamp is detached from the pipe string and retracted, whereupon the wedges are raised to their inactive position and the pipe string may move freely through the slips.

The method and device according to the invention renders superfluous an operation that is relatively difficult and dangerous, and also increases the efficiency of the work involved in tripping in and out of a well.

The following describes a non-limiting example of a preferred embodiment illustrated in the accompanying drawings, in which.

Figure 1:
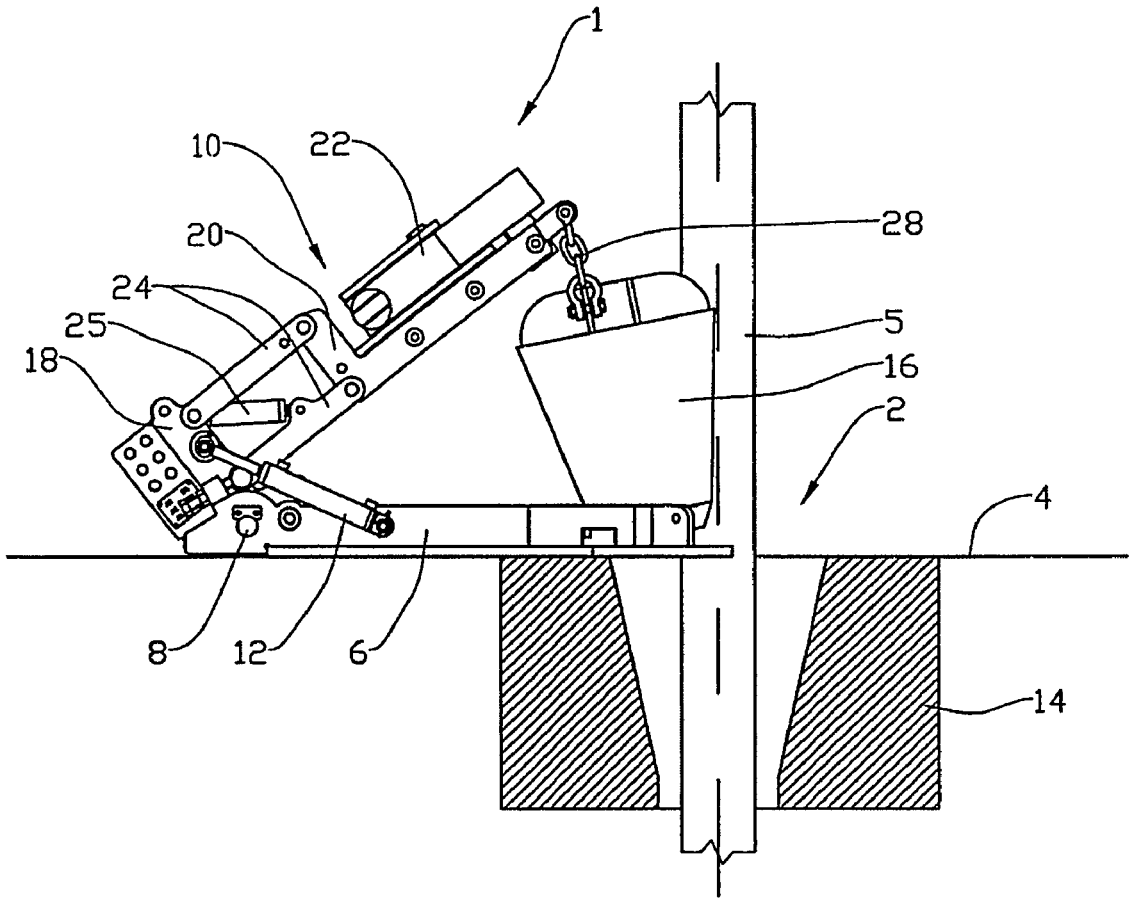
FIG. 1 is a side view of a wedge manipulator and where the slips sleeve is shown in section, the wedges of the slips being in their inactive position, whereby the pipe string may move freely through the sleeve of the slips.

In the drawings, reference number 1 denotes a slips manipulator arranged by a slips 2 on a drill floor 4. A pipe string 5 passes through the slips 2.

Figure 2:
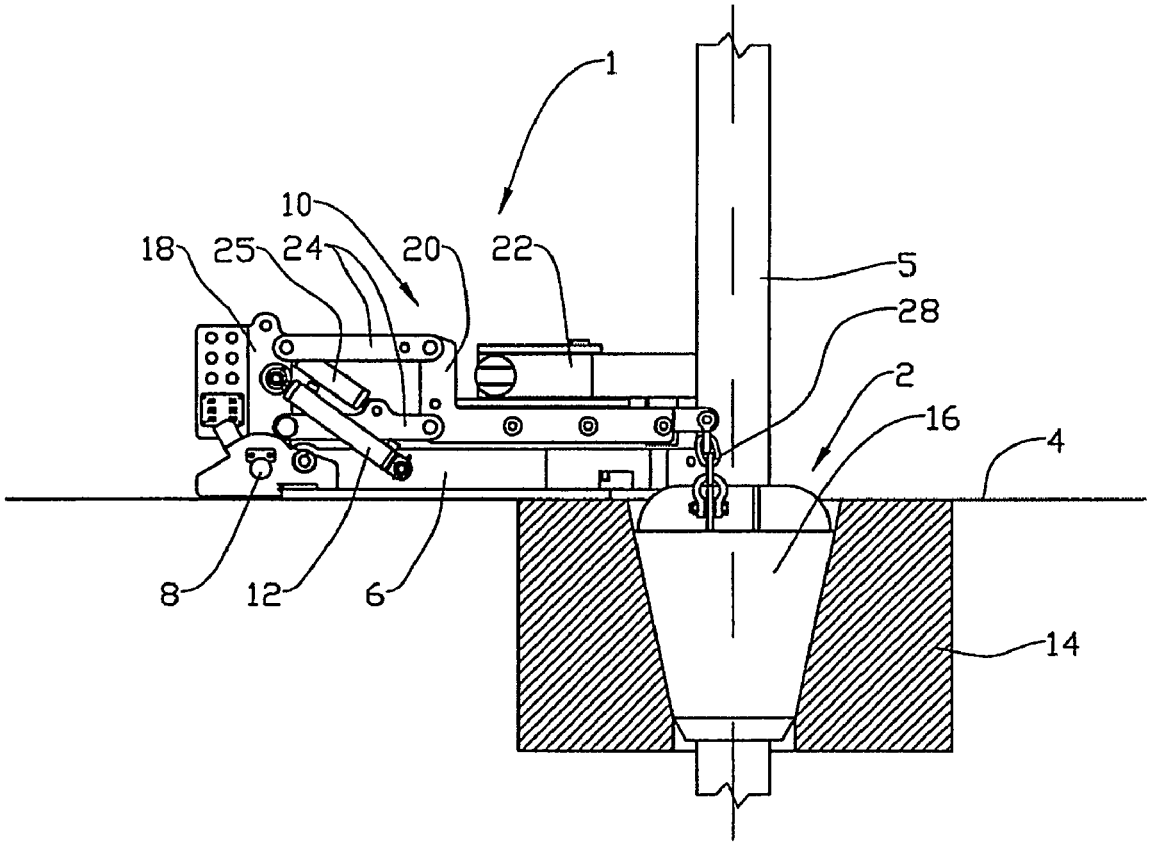
FIG. 2 shows the same as FIG. 1, but here the wedges are in the active position in the slips sleeve.

The slips manipulator 1 comprises a foundation frame 6 rigidly mounted to the drill floor 4, a working frame 10 mounted to the foundation frame 6 in a manner so as to be rotatable about a rotational axis 8, and two swivel cylinders 12 designed to rotate the working frame about the rotational axis 8, see FIGS. 1 and 2.

The slips 2, which is of a type that is known per se, comprises a sleeve 14 and one or more interconnected wedges 16, where the sleeve 14 is connected to the drill floor 4.

Figure 4:
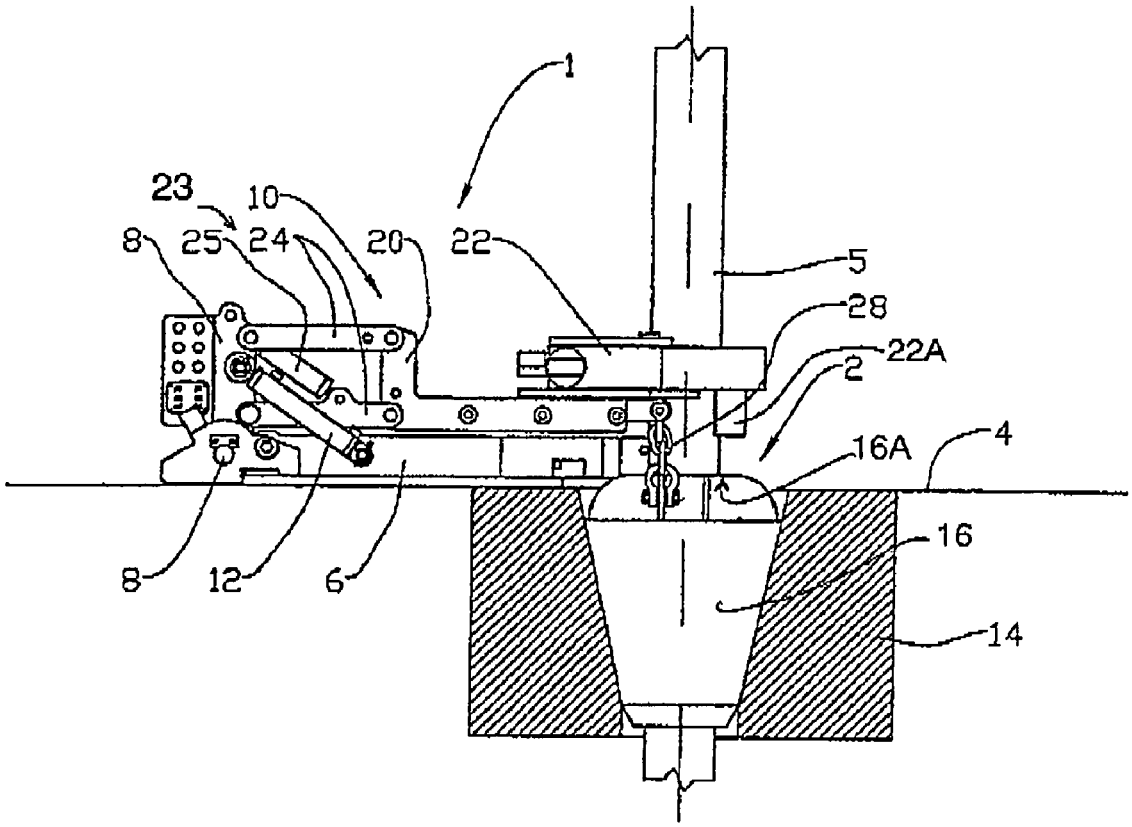
FIG. 4 shows the slips manipulator in the same position as that of FIG. 2, but here the pipe clamp of the slips manipulator has been moved to a stop against the pipe string.
Figure 6:
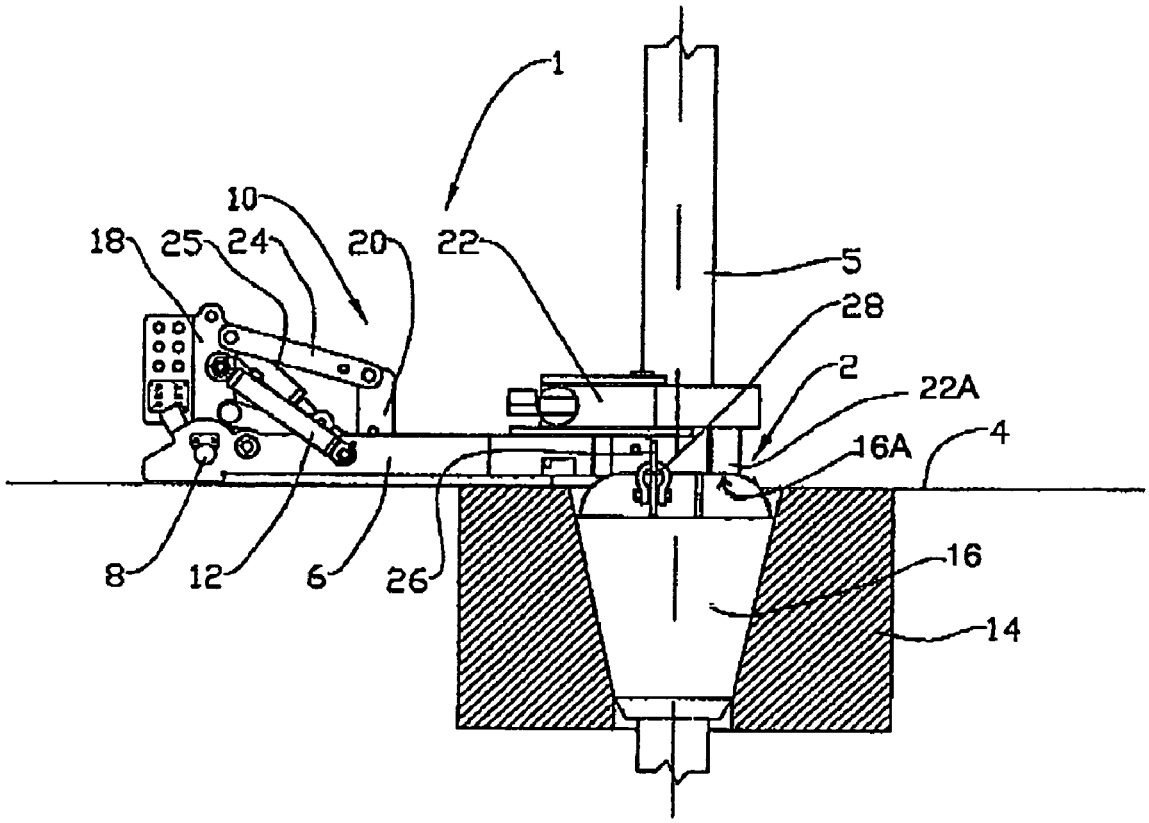
FIG. 6 shows the same as FIG. 4 after the pipe clamp has been arranged grippingly around the pipe string, and the pipe string has slipped downwards so as to leave the pipe clamp abutting the wedges.

The working frame 10 comprises a swivel bracket 18 mounted to the foundation frame 6 in a manner so as to be rotatable about a rotational axis 8, and an arm frame 20 equipped with a movable pipe clamp 22. The arm frame 20 is connected to the swivel bracket 18 in a manner such as to be displaceable in parallel with this, by means of a vertical displacement assembly 23 that includes four parallel arms 24 and two parallel cylinders 25. The parallel arms 24 are hinged at both ends to the swivel bracket 18 and the arm frame 20 respectively. The two parallel cylinders 25 are designed to displace the arm frame 20 in parallel with the swivel bracket 18 and vertically, as illustrated in FIGS. 4 and 6. The protruding end portions 26 of the arm frame 20 are connected by chains 28 to the slips 16.

Figure 7:
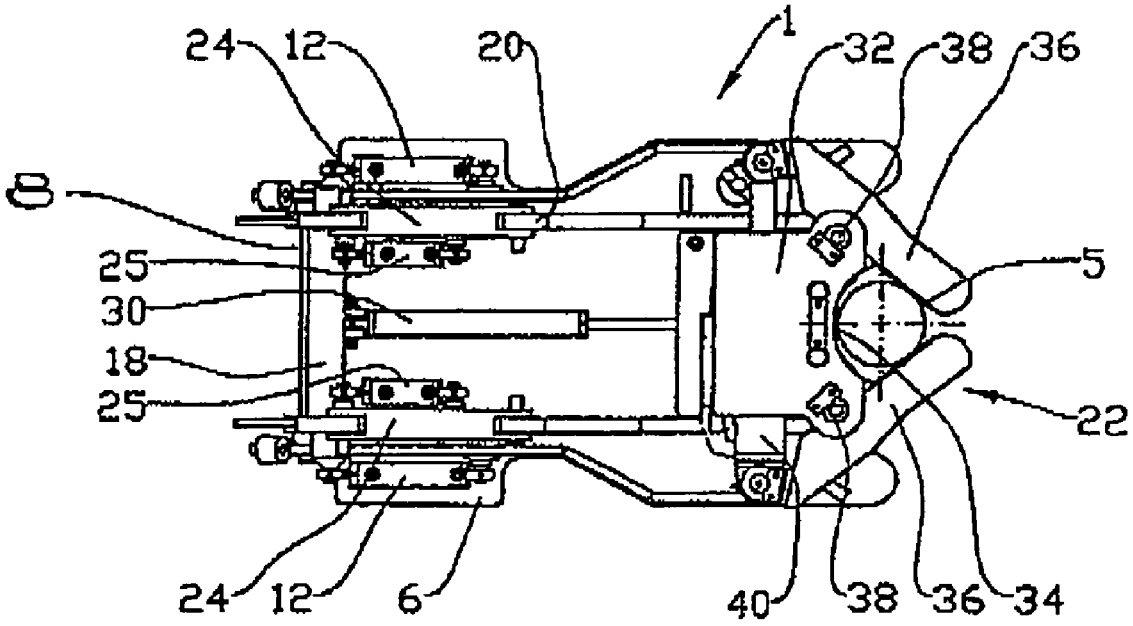
FIG. 7 is a plan view of the slips manipulator of FIG. 6.

The arm frame 20 also forms abutment faces and guides for the pipe clamp 22. The pipe clamp 22 is designed to be displaced towards/away from the pipe string 5 by a displacement cylinder 30, and comprises, in addition to a guide frame 32, a back stop 34 and clamping arms 36 rotatably connected to the guide frame 32 at respective hinges 38. A clamping cylinder 40, see FIG. 7, is designed to rotate the clamping arms about the hinges 38.

Figure 3:
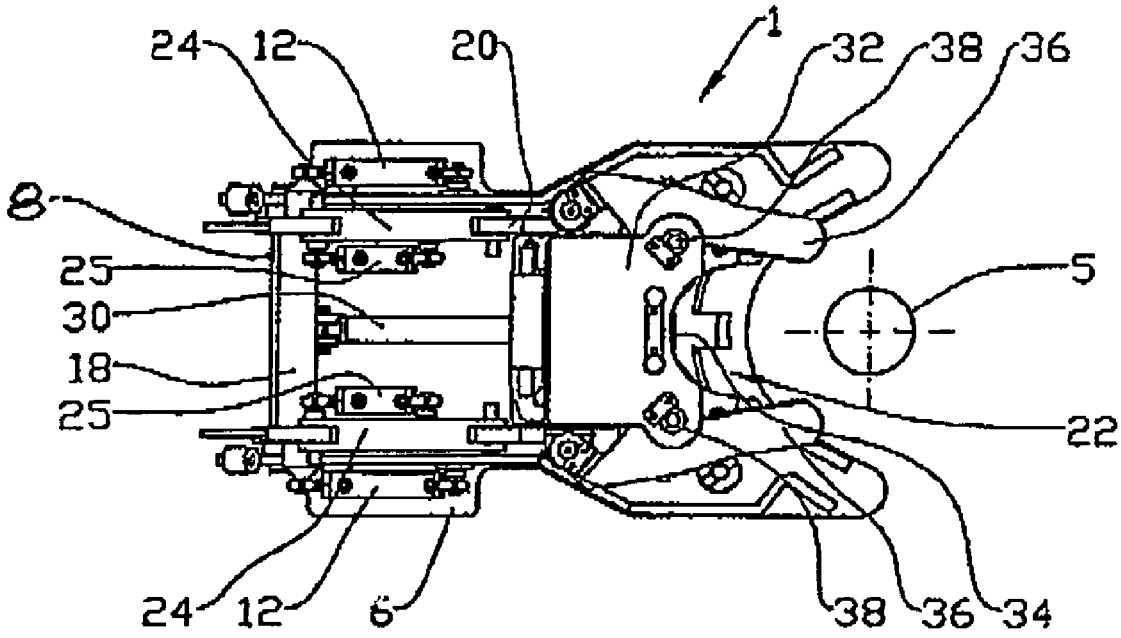
FIG. 3 is a plan view of the slips manipulator of FIG. 2.

From the initial position, see FIG. 1, the working frame 10 is rotated about the rotational axis 8 by means of the swivel cylinders 12 to place the slips 16 in the active, locking position in the sleeve 14, see FIGS. 2 and 3. At the same time, the position of the working frame 10 is essentially horizontal.

Figure 5:
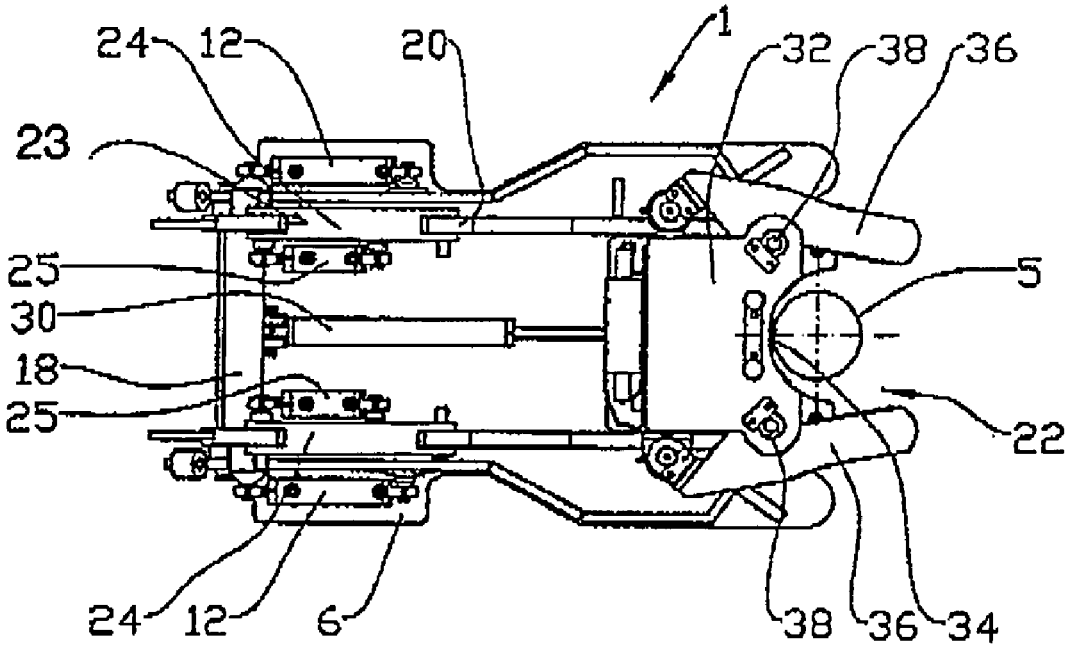
FIG. 5 is a plan view of the slips manipulator of FIG. 4.

The pipe clamp 22 is then moved towards the pipe string 5 along the arm frame 20 by means of the displacement cylinder 30, until the back stop 34 stops against the pipe string 5, see FIGS. 4 and 5.

The clamping arms 36 then clamp the pipe string 5 firmly against the back stop 34 by the clamping cylinder 40 rotating the clamping arms 36 about the hinges 38. FIG. 4 shows a push block 22A on the lower edge of the pipe clamp 22 and an upper edge 16A of the wedges 16. If the pipe string were to slip in the slips 2, the pipe clamp 22 clamped around the pipe string 5 and the arm frame 20 will be displaced downwards in parallel, through the parallel cylinders 25 yielding and the parallel arms 24 rotating about their respective end portions until the push block 22A on the pipe clamp 22 stops against the upper edge 16A of the wedges 16, see FIGS. 6 and 7. The wedges 16 are thereby forced further into the sleeved 14, making them grip the pipe string more firmly.

Figure 8:
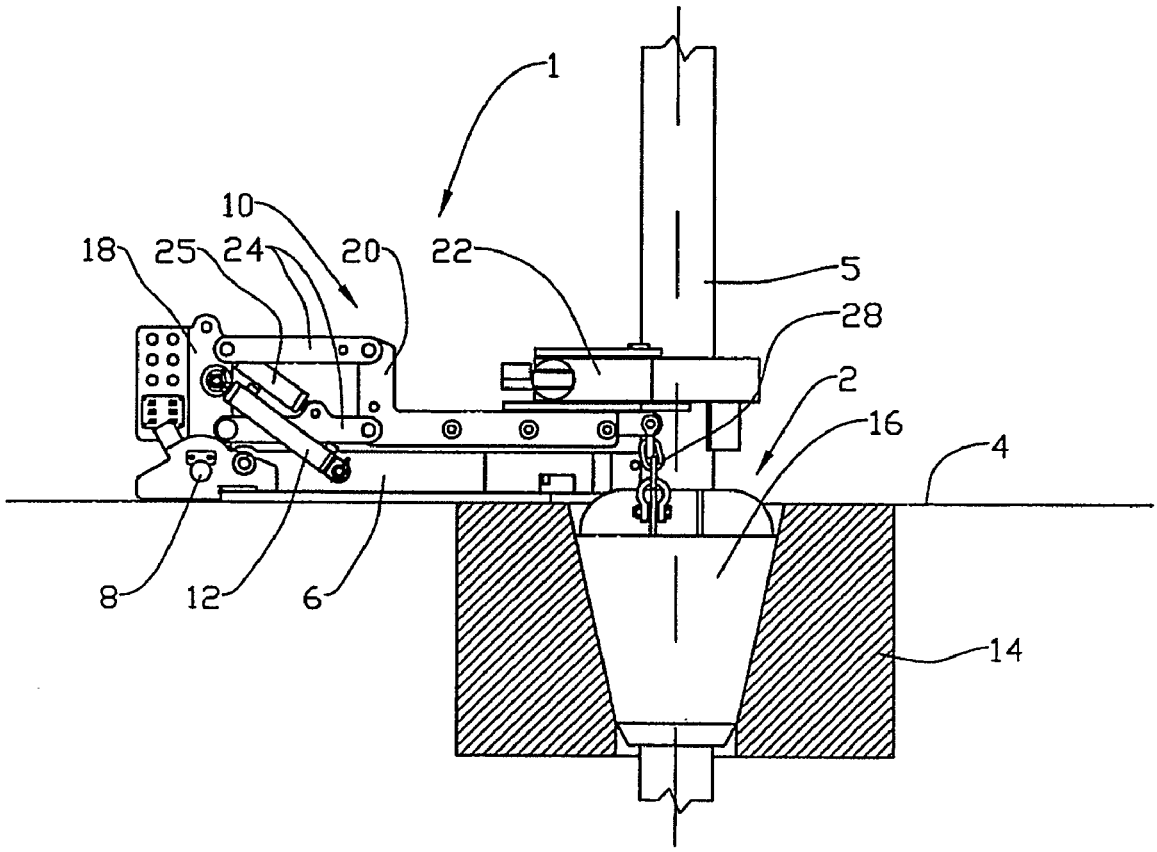
FIG. 8 shows the slips manipulator with the pipe clamp open and ready to be retracted from the pipe string, and the manipulator is about to pull the wedges out of the locking position.
Figure 9:
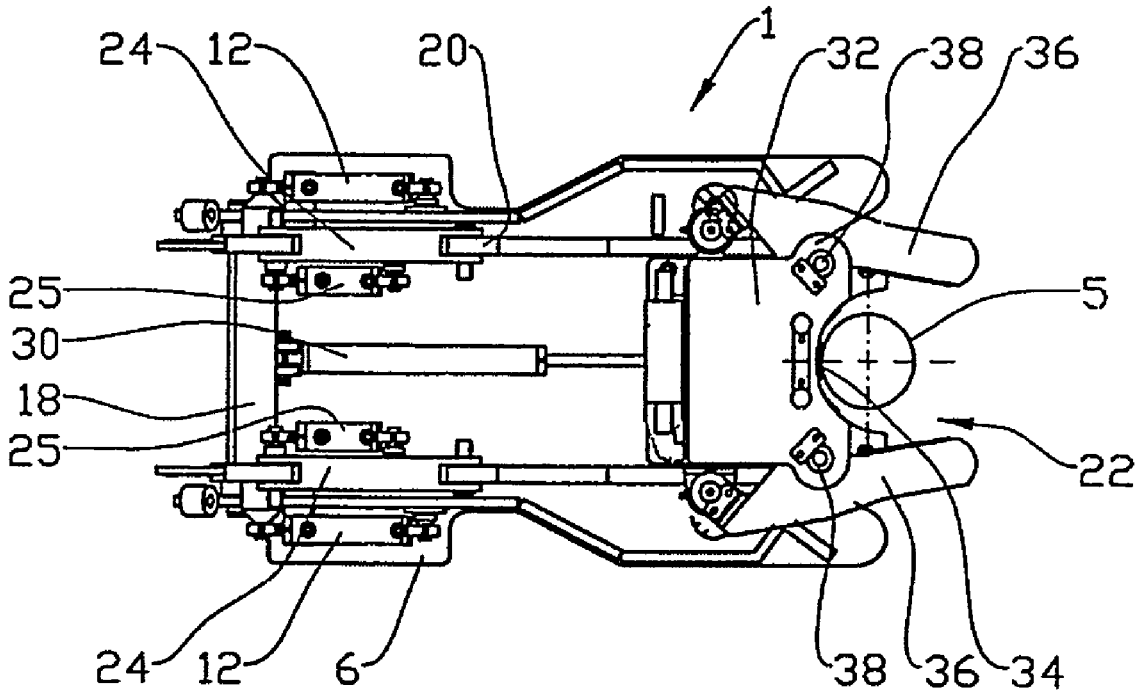
FIG. 9 is a plan view of the slips manipulator of FIG. 8.
Figure 4:
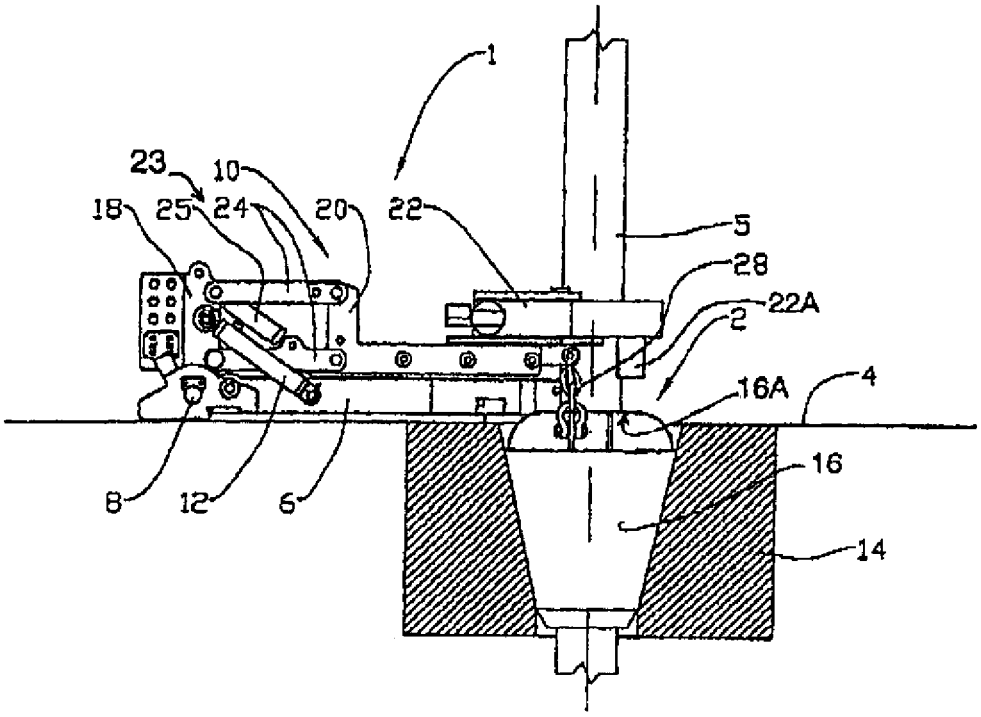

When the pipe string 5 is to be released from the slips 2, the clamping arms 36 are opened by means of the clamping cylinder 40, whereby the parallel cylinders 25 can move the arm frame 20 to the relieved position, see FIGS. 8 and 9. Then the pipe clamp 22 is moved away from the pipe string 5 by means of the displacement cylinder 30, the slips 2 is relieved by the weight of the pipe string being taken up by a hoisting winch (not shown) in the drilling device, whereupon the wedges 16 are raised to their inactive position by the working frame 10 being rotated about the rotational axis 8 to its initial position by means of the swivel cylinders 12, see FIG. 1.

Advantageously, all the cylinders 12, 25, 30, and 40 are hydraulically operated. The chains 28 can comprise any type of connection element.

The slips manipulator is well suited for remote control, or possibly automation, through use of valves, manoeuvering means, digital control means, hose connections and electrical cable connections (none shown) to e.g. a remote control station (not shown).

The invention claimed is:

1. A device for preventing a pipe string clampingly arranged in a slips from slipping out of said slips, said device comprising:

a mechanised wedge manipulator adapted to couple with a slips wedge and to manipulate a pipe string in said slips, said mechanised wedge manipulator including a foundation frame that is adapted to be mounted on a drill floor, a working frame comprising a swivel connection and a vertical displacement assembly, an arm frame, and a pipe clamp;

wherein said foundation frame has an axis about which said working frame rotates said swivel connection being rotatably mounted on said axis;

wherein said arm frame has a first arm-frame end and a second arm-frame end, said pipe-clamp being mounted on said second arm-frame end;

wherein said first arm-frame end is coupled to said swivel connection via said vertical displacement assembly, said arm frame being rotatable toward or away from said slips by means of said swivel connection, and said arm frame being vertically repositionable by means of said vertical displacement assembly, and wherein said arm frame maintains a parallel orientation to said foundation frame while being vertically repositioned and while said pipe clamp is in a pipe-clamping position; and wherein said slips wedge is inserted in said slips, and when said pipe clamp is clamped about said pipe string in said slips, said vertical displacement assembly is adapted to allow said arm frame to move downward until said pipe clamp rests on an upper edge of said slips wedge, thereby transferring weight of said pipe string to said slips wedge and forcing said slips wedge to more firmly grip said pipe string.

2. The device of claim 1, wherein said pipe clamp is mounted on said arm frame so as to be displaceable toward and away from said pipe string.

3. The device of claim 1, wherein said second arm-frame end is provided with a connection element that is adapted to suspendingly hold said slips wedge, said connection element being positionable over said slips.

4. The device of claim 1, said pipe clamp including a guide frame slidably mounted on said arm frame, said guide frame having a pair of pipe-clamp arms hingedly connected to a clamping cylinder that operates to move ends of said clamp arms toward each other or away from each other.

5. The device of claim 4, said guide frame further including a backstop.

6. The device of claim 4 further comprising a guide-frame displacement cylinder that is connected to said working frame at one end and to said guide frame at another end, for translationally displacing said guide frame on said arm frame.

7. The device of claim 1, wherein said vertical displacement assembly includes a vertical displacement cylinder pivotally connected at a first end to said swivel connection and at a second end to said arm frame, and wherein said vertical displacement cylinder selectively extends and retracts to lower and raise said arm frame.

8. The device of claim 1, said pipe clamp further including a push block, wherein, when said pipe string is clamped by said pipe clamp and said arm frame is lowered, said push block exerts a downward force on said slips wedge.

9. A mechanised wedge manipulator for preventing a pipe string clampingly arranged in a slips from slipping out of said slips, said mechanised wedge manipulator comprising:

a foundation frame that is adapted to be mounted on a drill floor;

a working frame comprising a swivel bracket and a vertical displacement linkage that is hydraulically operated;

an arm frame; and a pipe clamp adapted to couple with a slips wedge and to manipulate a pipe string in said slips;

wherein said foundation frame has an axis on which said swivel bracket is rotatably mounted;

wherein said arm frame has a first arm-frame end and a second arm-frame end, said pipe clamp being mounted on said second arm-frame end and said first arm-frame end being pivotably coupled with said vertical displacement linkage;

wherein said arm frame is rotatable toward or away from said slips by means of said swivel bracket; and wherein said arm frame is vertically repositionable by means of said vertical displacement linkage while said pipe clamp is in a pipe-clamping position, such that said arm frame maintains a parallel orientation to said foundation frame while being vertically repositioned.

10. The mechanised wedge manipulator of claim 9, wherein said vertical displacement linkage includes a vertical displacement cylinder and at least two parallel arms for vertically repositioning said arm frame, said vertical displacement cylinder being pivotally coupled at a first end to said swivel bracket and at a second end with said one of said parallel arms, wherein, when a piston in said cylinder extends, said arm frame is lowered and when said piston retracts, said arm frame is raised.

11. The mechanised wedge manipulator of claim 10, wherein said vertical displacement cylinder is hydraulically operable, so as to vertically raise or lower said pipe clamp.

12. The mechanised wedge manipulator of claim 9, whererin each parallel arm of said at least one pair of parallel arms is hingedly connected at a first end to said swivel bracket and at a second end to said arm frame, so as constrain vertical motion of said arm frame to maintain said parallel orientation to said foundation frame, and wherein, when said pipe clamp is clamped about said pipe string in said slip, a downward movement of said pipe string forces said arm frame to move vertically downward until said pipe clamp rests on an upper edge of said wedge, thereby transferring weight of said pipe string to said slips wedge and forcing said slips wedge to more firmly grip said pipe string.

13. The mechanised wedge manipulator of claim 9, wherein said pipe clamp is mounted on said arm frame so as to be displaceable toward and away from said pipe string.

14. The mechanised wedge manipulator of claim 13, said pipe clamp including a guide frame slidably mounted on said arm frame, said guide frame having pair of pipe-clamp arms hingedly connected to a clamping cylinder that operates to move ends of said clamp arms toward each other or away from each other.

15. The mechanised wedge manipulator of claim 14, said guide frame further including a backstop.

16. The mechanised wedge manipulator of claim 14, further comprising a clamp-displacement cylinder that is connected to said swivel bracket at one end and to said guide frame at another end, for translationally displacing, said guide frame on said arm frame.

17. The mechanised wedge manipulator of claim 9, said pipe clamp further including a push block, wherein, when said pipe string is clamped by said pipe clamp arms and said arm frame is lowered, said push block exerts said downward force on said slips wedge.

18. The mechanised wedge manipulator of claim 9, wherein said second arm-frame end is provided with a connection element that is adapted to suspendingly hold said slips wedge, said connection element being positionable over said slips.

* * * * *

UNITED STATES PATENT AND TRADEMARK OFFICE

CERTIFICATE OF CORRECTION

PATENT NO. : 7,337,861 B2
APPLICATION NO. : 10/498276
DATED : March 4, 2008
INVENTOR(S) : Tor Egil Mong and Tommy Johnsen It is certified that error appears in the above-identified patent and that said Letters Patent is hereby corrected as shown below:

Delete Drawing Sheet 4 of 9 and substitute the attached Drawing Sheet 4 of 9: Fig. 4.

Signed and Sealed this

Fourteenth Day of April, 2009

John Doll

JOHN DOLL
*Acting Director of the United States Patent and Trademark Office*